US005600425A

United States Patent [19]

Thayer et al.

[11] Patent Number: 5,600,425

[45] Date of Patent: Feb. 4, 1997

[54] CLEANER SYSTEM WITH CENTRAL AUGERING

[75] Inventors: Bruce E. Thayer; Dennis G. Gerbasi, both of Webster; Norman E. LaTour, Rochester, all of N.Y.

[73] Assignee: Xerox Corporation, Stamford, Conn.

[21] Appl. No.: 574,067

[22] Filed: Dec. 18, 1995

[51] Int. Cl.[6] ..... G03G 21/00

[52] U.S. Cl. ..... 399/353; 399/358

[58] Field of Search ..... 355/301, 302, 355/303, 298, 297; 15/256.5, 256.51, 256.52

[56] References Cited

U.S. PATENT DOCUMENTS

| | | | |
|---|---|---|---|
| 3,655,373 | 4/1972 | Fisher et al. . | |
| 4,494,863 | 1/1985 | Laing . | |
| 4,819,026 | 4/1989 | Lange et al. . | |
| 4,878,093 | 10/1989 | Edmunds | 355/297 |
| 5,179,416 | 1/1993 | Ku et al. | 355/297 |
| 5,233,398 | 8/1993 | Nimura et al. | 355/301 |
| 5,315,358 | 5/1994 | Parks | 355/302 |
| 5,329,344 | 7/1994 | Gerbasi et al. | 355/301 |

FOREIGN PATENT DOCUMENTS

| | | | |
|---|---|---|---|
| 57-204075 | 12/1982 | Japan | 355/303 |
| 61-122678 | 6/1986 | Japan | 355/302 |
| 05027651 | 2/1993 | Japan | 355/303 |

*Primary Examiner*—Robert Beatty
*Attorney, Agent, or Firm*—T. L. Fair

[57] ABSTRACT

An apparatus for a central augering system within a cleaning system. This central auger system provides several advantages including: 1) reduction in size of the overall cleaner; 2) prevention of bridging in the cleaner housing due to the close proximity of the auger to the detoning roll the toner falls directly into the auger; and 3) the second detoning roll which sees only a small amount of toner is lubricated by the toner in the auger.

12 Claims, 4 Drawing Sheets

CLEANER SYSTEM WITH CENTRAL AUGERING

BACKGROUND OF THE INVENTION

This invention relates generally to electrostatographic printers and copiers, and more particularly concerns a retracting cleaner with central augering.

In some electrostatographic printers and copiers, an opening is located at the bottom of the auger and a detoning blade is located under this opening. A concern of an auger running above the detoning scraper blade is that pressure would be exerted on the blade. Such a problem was experienced on machines such as the Xerox 5028 urethane cleaner blade. The 12 o'clock cleaner of this machine had a toner collection housing located above the blade. When toner filled the cavity, pressure from the accumulated toner flattened the blade against the photoreceptor causing a planing failure.

The multi-pass image on image color xerographic process includes four toner colors, cyan, magenta, yellow and black. These four colors are developed onto the photoreceptor belt through four cycles of the photoreceptor. During this time toner layers are built up to create a full color image which is then transferred to a sheet of paper. As the color layers are being developed all subsystems which could disturb the image must be retracted from photoreceptor contact. These subsystems include the dual electrostatic brush cleaner and the spots blade. Due to motion quality concerns effecting color registration the photoreceptor backers for the cleaner brushes cannot be retracted to withdraw the photoreceptor belt from the cleaner. Instead the cleaner must be withdrawn from the photoreceptor. Additionally the retraction and engagement must be accomplished in the short time between documents. And, because the size of the interdocument region is small relative to the spacing between the two brushes the brushes must be retracted and engaged independently. A cleaner with many independently moving parts can be very difficult to seal.

The following disclosures may be relevant to various aspects of the present invention and may be briefly summarized as follows:

U.S. Pat. No. 5,329,344 to Gerbasi et al. discloses a cleaning method and apparatus that provides lubrication to a secondary detoning roll in a cleaner brush system, thus reducing cleaning failures. The toner particles removed from the first detoning roll are transported to the second detoning roll. This allows lubrication of the second detoning roll and reduces the wear problem of the second detoning roll due to lack of lubrication.

SUMMARY OF INVENTION

Briefly stated, and in accordance with one aspect of the present invention, there is provided an apparatus for removing particles from a surface, comprising: means for cleaning the surface; at least two detoning members for detoning the particles from the cleaning means; and means for transporting the particles removed from the surface, the transporting means being centrally located along a centerline between the detoning members.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 5:
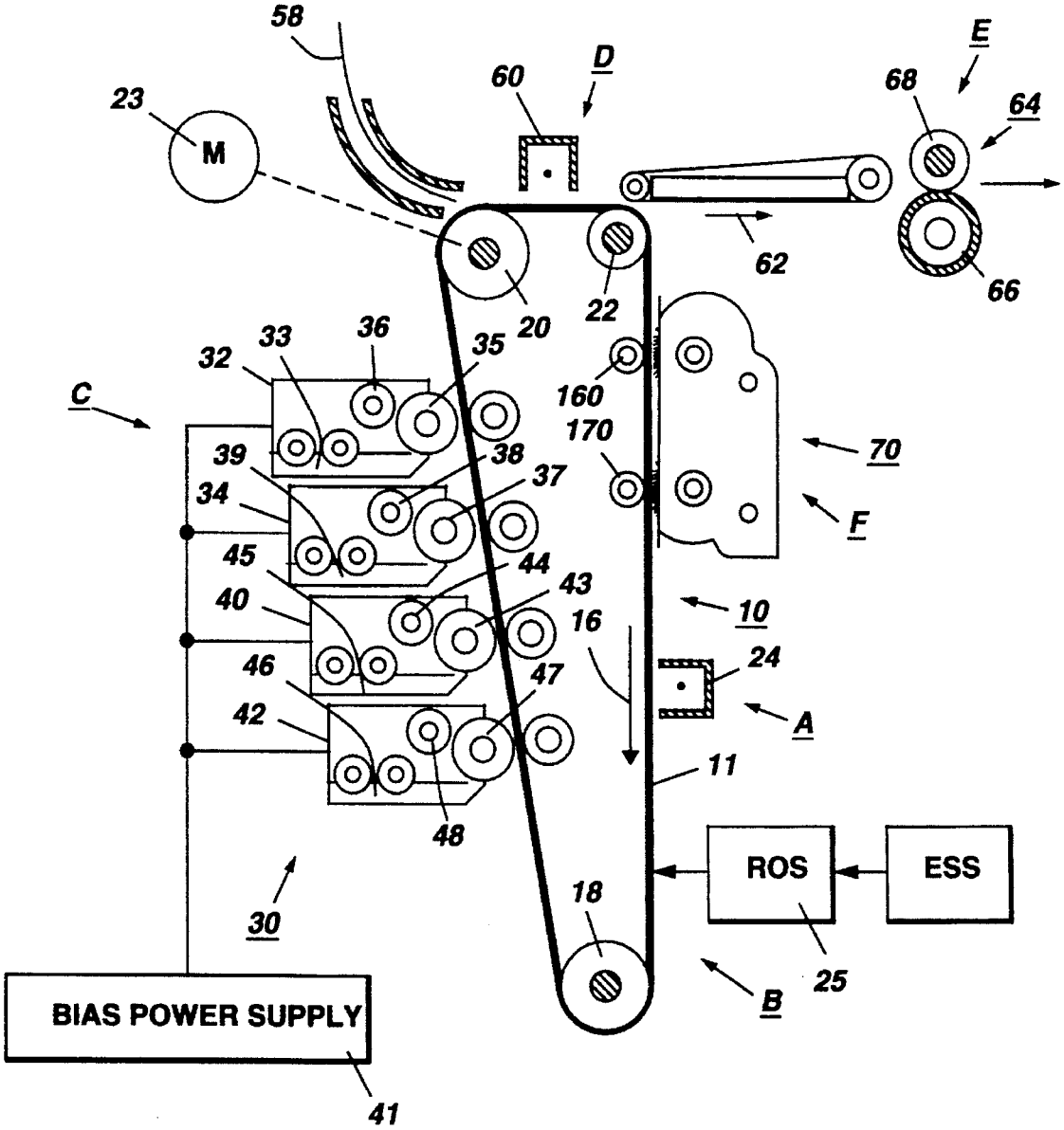
FIG. 5 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 5 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement pass charging station A, an exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by further reference to FIG. 5, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70. The cleaning system is supported under the photoreceptive belt by two backers 160 and 170.

Figure 1:
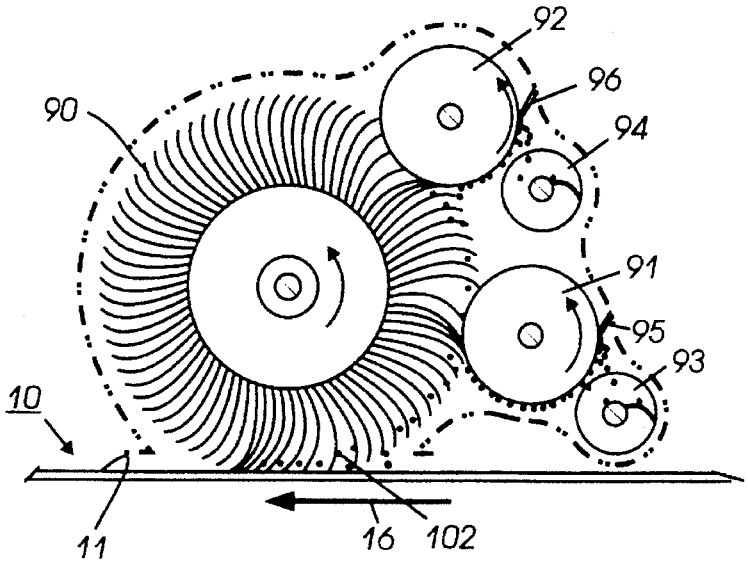
FIG. 1 PRIOR ART
FIG. 1 is an elevational schematic view of a prior art single brush cleaning system with two augers.

Reference is now made to FIG. 1, which shows an elevational schematic view of a prior art single brush cleaning system with two augers. This view shows a single brush 90 cleaner with two detoning rolls 91, 92 to remove toner particles 102 of both right sign and wrong sign from the brush 90. The majority of the toner particles 102 cleaned by the brush 90 (i.e. right sign toner)is removed by the first detoning roll 91. The remaining toner 102 (i.e. wrong sign toner) is removed by the second detoning roll 92. Due to the lack of adequate lubrication of the second detoning roll, brush shorting failures occurred when the anodized coating wore through on the second detoning roll 92. Each detoning roll has a scraper blade 95, 96 that removes toner particles 102 from the surface of the detoning rolls 91, 92 into an auger 93, 94.

Figure 2:
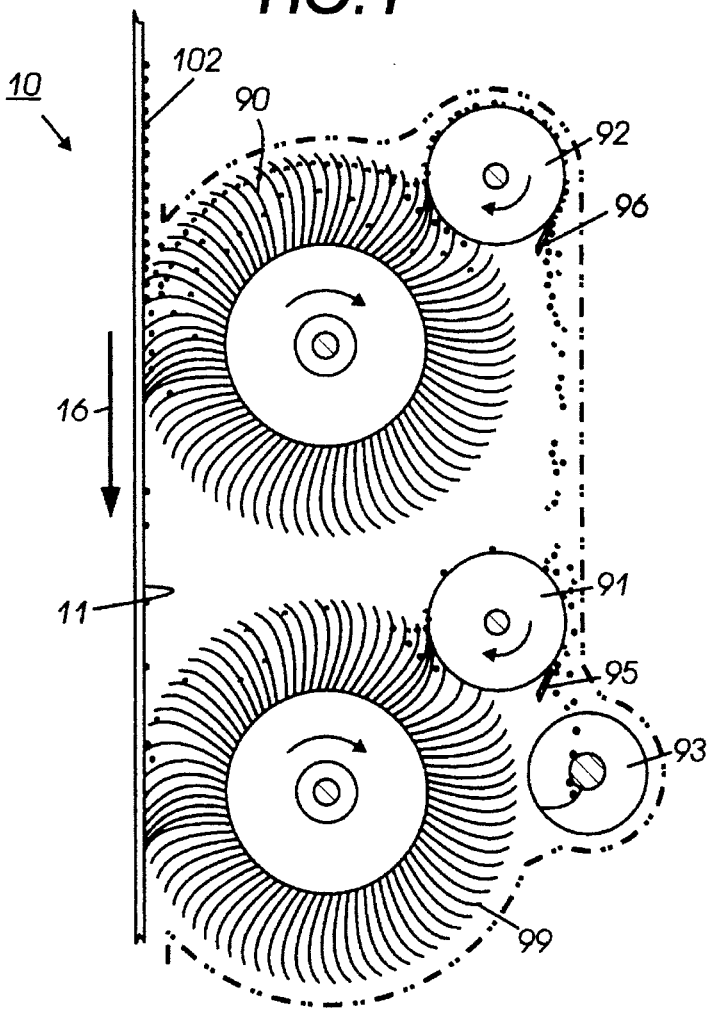
FIG. 2 PRIOR ART
FIG. 2 is an elevational schematic view of a prior art dual brush cleaner with an auger.

FIG. 2 shows a schematic of another prior art configuration of a cleaner system. In this figure, there are two cleaner brushes 90, 99. Each brush has a negative or positive charge to remove right sign and wrong sign toner. Most of the toner particles 102 are cleaned by the first brush 90 and then detoned by the first detoning roll 92. Very little toner remains for removal by the second brush 99 and subsequent detoning by the second detoning roll 91. To avoid the wear problem normally experienced on the second detoning roll 91, the toner particles 102 removed by the scraper blade 96 from the first detoning roll 92 is allowed to fall onto the second detoning roll 91 (because no auger is present below the scraper blade 96 to transport the toner particles 102 away). This falling toner provides adequate toner lubrication to the second detoning roll 91 and scraper blade 95 to prevent failures. The residual toner particles are then guided into the auger 93.

Figure 3:
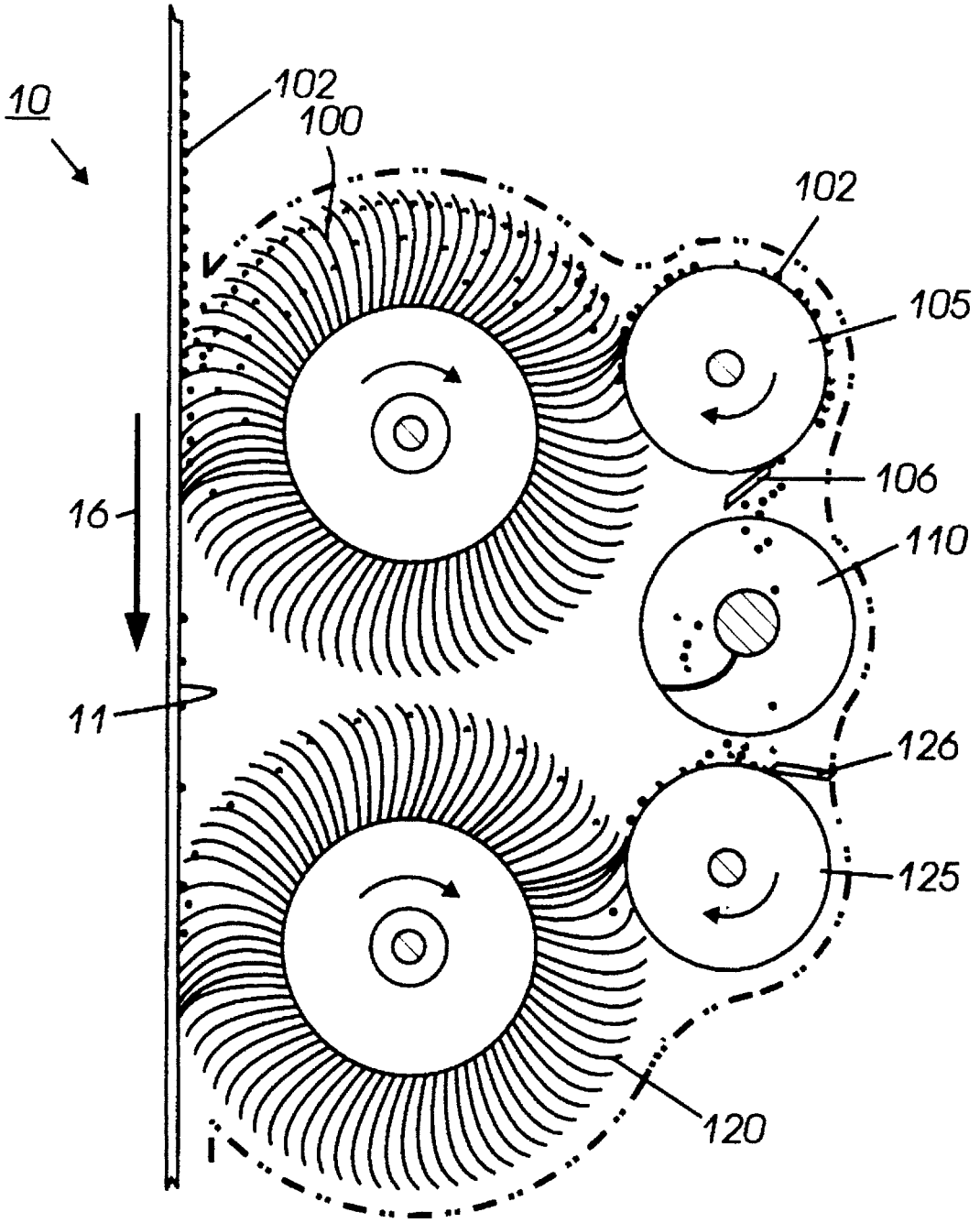
FIG. 3 is an elevational schematic view of the present invention of a brush cleaner with an auger centrally located between two detoning rolls.

Reference is made to FIG. 3, which shows an embodiment of the present invention having a miniaturized dual ESB retracting cleaner with a centrally located auger relative to the detoning rolls. (The present invention is also applicable to a non-retracting cleaner.) This embodiment of the present invention accomplishes two desired goals: lubrication of the scraper blade on the detone roll and miniaturization of the dual ESB (i.e. electrostatic brush) cleaner. The dual ESB cleaner in a multi-pass operation has a dual function, cleaning the toner particles 102 from the photoreceptor (e.g. imaging) surface 11 and retracting from the photoreceptor surface 11. The electrostatic cleaning brushes 100, 120 remove the toner particles 102 from the photoreceptor 10 that were not transferred during the transfer process. The detoning rolls 105, 125 located adjacent to the respective brushes 100, 120 electrostatically remove the residual toner particles 102 from the brushes 100, 125 onto the surface of the detoning rolls 105, 125. Scraper blades 106, 126 remove the toner particles from detoning rolls 105, 126, respectively.

With continuing reference to FIG. 3, the first brush 100, (located upstream from the second brush 120, in the direction of motion of the photoreceptor 10, shown by arrow 16), is biased opposite to the majority of the toner to be cleaned, enabling removal of the majority of toner 102 from the photoreceptor 10 by the first brush 100. The second brush 120, (located downstream from the first brush 100, in the direction of motion of the photoreceptor 10, shown by arrow 16), is biased opposite to the polarity of the first brush 100, enabling the second brush 120 to clean the wrong sign toner. In the prior art of a dual brush cleaner (not shown), the second brush sees very small amounts of toner during normal cleaning operations causing the scraper blade for the adjacent second detoning roll to fail prematurely due to lack of toner lubrication. Likewise, in the prior art of a single brush cleaner 90 with two or more detoning rolls (see FIG. 1), the second detoning roll and respective scraper blade can fail prematurely due to lack of toner lubrication.

Figure 4:
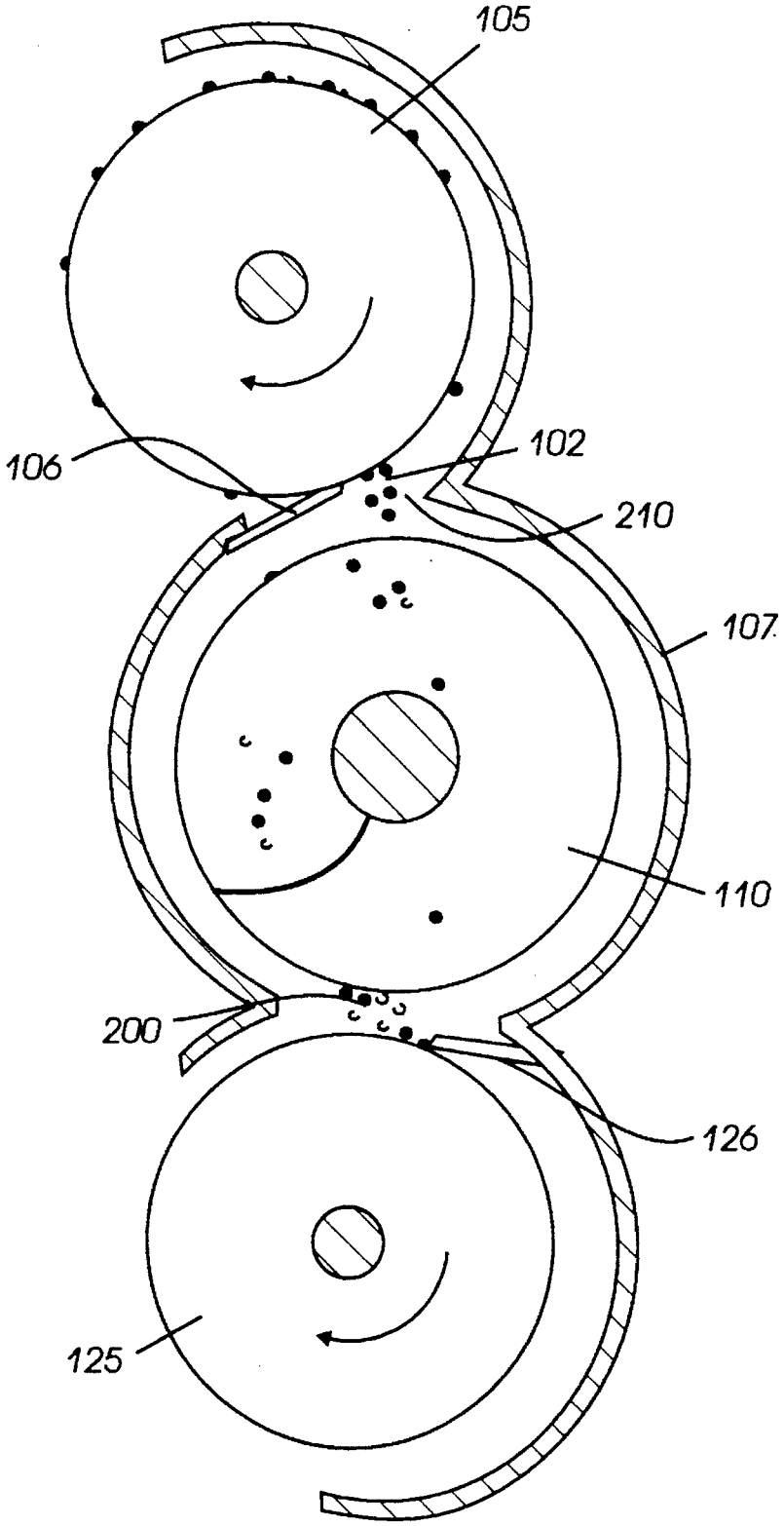
FIG. 4 shows an enlarged schematic elevational view of the auger relative to the detoning rolls in the present invention.

Referring now to FIG. 4, which shows an enlarged schematic elevational view of the auger relative to the detoning rolls in the present invention. This embodiment of the present invention, locates the auger assembly 110 midway between and, slightly to the rear of the centerline of the detone rolls 105, 125. This location allows the residual toner 102 to fall directly off of the first detone roll 105 as it is scraped off by the scraper blade 106 into the top 210 of the auger channel or cavity for removal to a waste bottle (not shown). Additionally, this auger 110 location allows, by having the bottom 200 of the auger open, the second scraper blade 126 on detoning roll 125 to be submerged in a "wedge" of residual toner 102, insuring lubrication of this scraper blade 126. The surplus amounts of residual toner 102 are fed into the bottom of the auger for removal to a waste bottle. The reduction in the housing size by using this architecture is a major benefit.

With continuing reference to FIG. 4, in the present invention, a concern with the cleaner configuration involves the toner transport auger reliability and the transport rate with a gap at the bottom 200 of the auger tube where the second detoning blade 126 is located. Experimental testing of the cleaner auger apparatus of the present invention (i.e. a transport auger with a space below the center of the auger tube of various depths) showed no difficulties with the reliable operation of the auger 110. Additionally, the maximum transport rate of the auger did not change after steady state conditions were reached. The space below the auger fills with toner 102 and the toner 102 is then efficiently transported across the accumulated pile of toner as it would be in a common configuration of an auger. This is because the toner transported in an auger, in most configurations, is normally riding on the bottom layer of toner pushed along the auger tube by the auger flute or spring. In the present invention, the toner in the space 200 below the auger builds up to the level of a complete auger tube and then acts as though it were the bottom of the auger tube.

With reference to FIG. 3, another concern of a cleaning apparatus with an auger 110 running above the detoning scraper blade 126 is that pressure would be exerted on the blade 126. Such a problem has been experienced on machines such as the Xerox 5028 urethane cleaner blade. The 12:00 cleaner of the Xerox 5028 machine had a toner collection housing located above the blade. When toner filled the cavity, pressure from the accumulated toner flattened the blade against the photoreceptor causing a planing failure. This problem appeared when the toner cavity was filled creating the extra pressure on the blade. A force transducer was located at the bottom of the opening (e.g. space) below the auger of the simulated hardware described above to determine if the central auger of the present invention experienced detoning blade failures from pressure created by the transport auger. No significant increases in the pressure at the bottom of the auger space were observed, in the present invention.

Furthermore, experimentation showed that no significant pressures were exerted on the detoning scraper blade 126. Additionally, the auger parameters of the present invention (i.e. diameter, speed and pitch) are chosen such that the auger maximum toner transport rate is higher than the toner input rate. This is to insure that no significant toner pressures build up in the auger cavity.

The following are some of the advantages of the present invention that utilizes a central auger. The present invention: prevents toner bridging in the cleaner housing (i.e. the auger is very close to the scraper blades that guide the toner removed from the detoning rolls into the auger); provides very good toner lubrication of the second detoning roll scraper blade (i.e. the scraper blade is located below the auger where a toner pile is released); reduces the size of the cleaner apparatus design (i.e. allows the brushes to be moved close together); allows convenient use of the central auger rigid core, through the helical auger, as the cleaner drive input shaft (i.e. the auger shaft located between detoning rolls can easily drive the brushes, the detoning rolls and the retraction mechanism); with the auger core shaft as a cleaner drive input shaft, minimizes toner in the auger (i.e. the input shaft rotates whenever the main drive power is on, the brushes, detoning rolls and retraction mechanism operate only intermittently through clutches driven by the auger shaft); and increases the cleaner reliability (due to improvement in toner bridging, blade lubrication and the toner level in the augers).

In recapitulation, the present invention describes a central auger system incorporated into a mini-dual ESB cleaner. The auger is located between the detoning rolls, and close to the detoning rolls. This central auger system provides several advantages including: 1) reduction in size of the overall cleaner; 2) prevention of bridging in the cleaner housing (i.e. due to the close proximity of the auger to the detoning roll the toner falls directly into the auger); and 3) the second detoning roll, which sees only a small amount of toner is lubricated by the toner in the auger.

It is, therefore, apparent that there has been provided in accordance with the present invention, a cleaner having a central auger that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing particles from a surface, comprising:

means for cleaning the surface;

at least two detoning members for detoning the particles from the cleaning means, said detoning members comprising a first detoning roll and a second detoning roll, said first detoning roll having a first scraper blade in frictional contact with said first detoning roll, the first scraper blade removing particles from said first detoning roll, said second detoning roll having a second scraper blade in frictional contact with said second detoning roll, the second scraper blade removing particles from said second detoning roll; and means for transporting the particles removed from the surface, said transporting means being centrally located along a centerline between said detoning members, said first scraper blade and said second scraper blade defining portions of a channel to the same transporting means.

2. An apparatus as recited in claim 1, wherein said cleaning means comprises a brush.

3. An apparatus as recited in claim 2, wherein said brush is electrostatic.

4. An apparatus as recited in claim 2, wherein said transporting means comprises an auger.

5. An apparatus as recited in claim 4, wherein said auger comprises two openings, a first opening and a second opening.

6. An apparatus as recited in claim 5, wherein said first opening being located opposite said second opening.

7. An apparatus as recited in claim 6, wherein said auger being centrally located between said detoning rolls enables said first scraper blade to guide the particles removed from said first detoning roll into said first opening of said auger.

8. An apparatus as recited in claim 7, wherein said auger being centrally located between said detoning rolls enables said second scraper blade to guide the particles removed from said second detoning roll into said second opening of said auger.

9. An apparatus as recited in claim 8, wherein said auger being centrally located between said detoning rolls prevents bridging of the particles over said first opening of said auger.

10. An apparatus as recited in claim 9, wherein said second detoning roll being lubricated by the particles in said auger at said second opening of said auger.

11. An apparatus as recited in claim 10, wherein said detoning rolls and said brush have motion.

12. An apparatus as recited in claim 11, wherein said auger has a drive input shaft for moving said detoning rolls and said brush.

* * * * *